US010188213B2

(12) United States Patent
Johnson et al.

(10) Patent No.: US 10,188,213 B2
(45) Date of Patent: Jan. 29, 2019

(54) DUAL MOTION SLOPED FLOOR RECLINE MECHANISM FOR A THEATER SEAT

(71) Applicant: VIP Cinema LLC, New Albany, MS (US)

(72) Inventors: Terry Dale Johnson, Baldwyn, MS (US); Jeffrey Bowen, New Albany, MS (US); Stephen Simons, New Albany, MS (US)

(73) Assignee: VIP CINEMA, LLC, New Albany, MS (US)

( * ) Notice: Subject to any disclaimer, the term of this patent is extended or adjusted under 35 U.S.C. 154(b) by 145 days.

(21) Appl. No.: 15/155,929

(22) Filed: May 16, 2016

(65) Prior Publication Data

US 2016/0331143 A1 Nov. 17, 2016

Related U.S. Application Data

(60) Provisional application No. 62/162,558, filed on May 15, 2015, provisional application No. 62/162,607, (Continued)

(51) Int. Cl.
*A47C 1/03* (2006.01)
*A47C 1/12* (2006.01)
(Continued)

(52) U.S. Cl.
CPC ..... *A47C 7/008* (2013.01); *A47C 1/03211* (2013.01); *A47C 1/121* (2013.01); *A47C 7/56* (2013.01)

(58) Field of Classification Search
CPC . A47C 1/032; A47C 1/03211; A47C 1/03205; A47C 1/12; A47C 1/121;
(Continued)

(56) References Cited

U.S. PATENT DOCUMENTS 3,558,185 A 1/1971 Mizelle
5,288,128 A 2/1994 Smith et al.
(Continued)

FOREIGN PATENT DOCUMENTS

DE 102015102007 B3 * 7/2016 ..... A47C 1/024
WO WO2016164281 A1 10/2016

OTHER PUBLICATIONS

International Search Report and Written Opinion, PCT/US2016/032585, dated Aug. 12, 2016.
(Continued)

*Primary Examiner* — Ryan D Kwiecinski
(74) *Attorney, Agent, or Firm* — Winston & Strawn LLP

(57) ABSTRACT

Provided is a dual motion recline mechanism for a seating assembling and seating assembly including the same. The seating assembly provides a user with the ability to both tilt the seat member so as to save space and the comfort of a back member capable of reclining. The recline mechanism includes a seat frame carrier assembly, a seat pivot pin, a seat carrier chassis plate, a rear pivot link, a chassis mounting plate, a back frame assembly, and a linear actuator connected by various pivotal, sliding or fixed connections. The linear actuator is remotely situated including for example behind the back frame assembly or under an arm rest. Optional elements include a seat front guide block, a seat front guide rod, back frame guide block and a back guide pin. The seating assembly may be a theater seat. The seating assembly may be mounted on a flat or sloped surface.

19 Claims, 16 Drawing Sheets

Related U.S. Application Data filed on May 15, 2015, provisional application No. 62/161,837, filed on May 14, 2015, provisional application No. 62/161,876, filed on May 14, 2015.

(51) Int. Cl.

| | |
|---|---|
| ***A47C 7/00*** | (2006.01) |
| ***A47C 7/56*** | (2006.01) |
| ***A47C 1/121*** | (2006.01) |
| ***A47C 1/032*** | (2006.01) |

(58) Field of Classification Search

CPC ..... A47C 7/008; A47C 7/56; A47C 7/563; B64D 11/064; B60N 2/242

See application file for complete search history.

(56) References Cited

U.S. PATENT DOCUMENTS

| | | | | |
|---|---|---|---|---|
| 5,393,120 | A | 2/1995 | Woods et al. | |
| 6,582,020 | B1 * | 6/2003 | Tenenboym | A47C 1/121 297/188.14 |
| 6,742,841 | B1 * | 6/2004 | Soditch | A47C 7/56 297/335 |
| 6,840,575 | B2 | 1/2005 | Hesse | |
| 8,262,163 | B2 | 9/2012 | Wu | |
| 8,434,822 | B2 | 5/2013 | Asbjornsen | |
| 8,534,759 | B2 | 9/2013 | De La Garza et al. | |
| 2004/0012231 | A1 | 1/2004 | Hesse | |
| 2010/0102608 | A1 | 4/2010 | Sakamoto | |
| 2010/0171343 | A1 | 7/2010 | Asbjornsen | |
| 2011/0127824 | A1 | 6/2011 | Wu | |
| 2012/0074751 | A1 | 3/2012 | De La Garza et al. | |
| 2012/0286557 | A1 | 11/2012 | Hoffman et al. | |
| 2017/0021930 | A1 * | 1/2017 | Henshaw | B64D 11/064 |
| 2017/0105531 | A1 * | 4/2017 | Jacobs | A47C 1/126 |
| 2017/0325590 | A1 * | 11/2017 | Jacobs | A47C 1/126 |
| 2018/0092465 | A1 * | 4/2018 | Seibold | A47C 7/462 |

OTHER PUBLICATIONS

International Search Report and Written Opinion, PCT/US2016/032758, dated Aug. 12, 2016.

U.S. Appl. No. 15/155,004, filed May 14, 2016.

* cited by examiner

Closed and Upright Position (Occupied)–Side View

Closed and Upright Position (Occupied)–Front View

Seat Down Position (Occupied)–Left Side View

Seat Down Position (Occupied)–Right Side View

Seat Up Position (Unoccupied)–Left Side View

Seat Up Position (Unoccupied)–Right Side View

Left Side View
Seat Down
Recline Closed

Front View

Right Side View
Seat Down
Recline Closed

DUAL MOTION SLOPED FLOOR RECLINE MECHANISM FOR A THEATER SEAT

PRIORITY

The present application claims the benefit of priority to U.S. Provisional Application Ser. No. 62/162,607 filed May 15, 2015, to U.S. Provisional Application Ser. No. 62/161,837 filed May 14, 2015, both titled "DUAL MOTION SLOPED FLOOR RECLINE MECHANISM FOR A THEATER SEAT" and to U.S. Provisional Application Ser. No. 62/161,876 filed May 14, 2015 and to U.S. Provisional Application Ser. No. 62/162,558 filed May 15, 2015 titled "MOTOR DRIVEN SLOPED FLOOR RECLINE MECHANISM FOR A THEATER SEAT". All said applications are hereby incorporated by reference in their entireties.

BACKGROUND OF THE INVENTION

Field of the Invention

The disclosure relates to a dual motion comfort chair recline mechanism. More particularly, the disclosure relates to a dual motion recline mechanism for a theater seat. Most particularly the disclosure relates to a theater seat with a pivoting seat member and a reclining back frame assembly that is designed to be mounted on either a leveled or a sloped floor.

Background

Theater seats for a movie theater are well known. Typically, the theater seat includes a vertical back member and a seating member operatively connected to the back member. The back member is generally fixed to the seating member usually by a stanchion secured to the floor of the theater. The seat member and the back member are also connected to a pair of armrests. The seating member is usually configured to pivot relative to the back member, between an upright position when unoccupied and a horizontal position when occupied by a user.

It is desirable, however, to provide theater seats that can furnish additional comfort to a user and the choice of a reclined back member in addition to the pivoting seat member. It is also desirable to furnish such a comfortable seat without having to occupy additional space and scarifying the maximum-allowed seating capability of a theater. The current disclosure provides a dual motion compact linkage system (also referred to as a recline mechanism) for a seating assembly (for example a theater seat) whereby the dual motion linkage system allows the concurrent pivoting of the seat member and the reclining of the back member of the seating assembly. The linkage system is designed such a seating assembly including this system can be mounted on a leveled or a sloped floor of varying degrees without occupying much space.

SUMMARY OF THE INVENTION

The current disclosure provides a dual motion recline mechanism and a seating assembly comprising the same. In an embodiment, the seating assembly is a theater seat. The seating assembly, however, may also be a bus seat, a train seat, an airplane seat, etc. The current disclosure also provides a dual motion recline mechanism particularly suitable for use on a sloped floor of varying degrees. The recline mechanism affords comfort to a theater seat and provides it with three different positional configurations, seat up-closed back when unoccupied, seat down-closed back and seat down-full back recline when occupied by a user.

Furthermore the current disclosure provides a dual motion recline mechanism for a seat assembly including a seat frame assembly wherein said seat frame is configured to pivot to an upright position when unoccupied by a user and to a horizontal down position when occupied by the user; a seat carrier chassis plate operatively connected to said seat frame assembly by pair of seat pivot pins, wherein said seat carrier chassis plate provides support for said seat frame assembly and is configured to allow the movement of said seat frame assembly; a chassis mounting plate connected to said seat frame assembly by rear pivot link and a seat front guide rod; a linear actuator; a pair of rear pivot links wherein each of said pair of rear pivot links is operatively connected at its upper end to said chassis mounting plate, at its center to said seat carrier chassis plate and at its lower end to said linear actuator; and a back frame assembly operatively attached to said seat carrier chassis plate and to said linear actuator, wherein when actuated by the user, said linear actuator seat causes carrier chassis plate to pull back frame assembly downward and forward and wherein also when actuated by the user, said linear actuator causes the pair of rear pivot links to rotate and pull said pair of seat carrier chassis plates in a down and forward direction thereby pulling seat frame assembly forward. The dual motion recline mechanism may have its seat frame assembly rigidly attached to said seat carrier chassis plate or attached by a pivotal connection.

Also provided is the dual motion recline mechanism described above but wherein further said back frame assembly is attached to said seat carrier chassis plate by a rigid connection or by a pivotal connection.

Further provided is dual motion recline mechanism for a seat assembly including a seat frame assembly wherein said seat frame is configured to pivot to an upright position when unoccupied by a user and to a horizontal down position when occupied by the user; a seat carrier chassis plate operatively connected to said seat frame assembly by pair of seat pivot pins, wherein said seat carrier chassis plate provides support for said seat frame assembly and is configured to allow the movement of said seat frame assembly; a chassis mounting plate connected to said seat frame assembly by rear pivot link and a seat front guide rod; a linear actuator; a pair of rear pivot links wherein each of the pair of rear pivot links is operatively connected at its upper end to said chassis mounting plate, at its center to the seat carrier chassis plate and at its lower end to the linear actuator; and a back frame assembly operatively attached to said seat carrier chassis plate and to said linear actuator, wherein when actuated by the user, the linear actuator seat causes carrier chassis plate to pull back frame assembly downward and forward and wherein also when actuated by the user, the linear actuator causes the pair of rear pivot links to rotate and pull said pair of seat carrier chassis plates in a down and forward direction thereby pulling seat frame assembly forward. The dual motion recline mechanism may have its back frame assembly attached to said seat carrier chassis plate by a pivotal connection. Also the dual motion recline mechanism may have the linear actuator situated behind said back frame assembly or under an arm rest attached to said seat assembly. Some embodiments further provided by the current disclosure are dual motion recline mechanisms and linkage systems where the linear actuator is attached to the rear pivot link and to a fixed base. The dual motion recline mechanism that is provided may further have the seat carrier chassis plate operatively connected to said seat frame assembly by pair of seat pivot pins at a pivotal connection points and/or a fixed base attached to said chassis mounting plate, a back frame guide block attached to said back frame assembly and at least one back guide pin, wherein said back guide pin is connected to said fixed base.

Further provided is a dual motion recline mechanism dual motion recline mechanism for a seat assembly including a seat frame assembly wherein said seat frame is configured to pivot to an upright position when unoccupied by a user and to a horizontal down position when occupied by the user; a seat carrier chassis plate operatively connected to said seat frame assembly by pair of seat pivot pins, wherein said seat carrier chassis plate provides support for said seat frame assembly and is configured to allow the movement of said seat frame assembly; a chassis mounting plate connected to said seat frame assembly by rear pivot link and a seat front guide rod; a linear actuator; a pair of rear pivot links wherein each of the pair/set of rear pivot links is operatively connected at its upper end to said chassis mounting plate, at its center to the seat carrier chassis plate and at its lower end to said linear actuator; and a back frame assembly operatively attached to the seat carrier chassis plate and to the linear actuator, wherein when actuated by the user, said linear actuator seat causes carrier chassis plate to pull back frame assembly downward and forward and wherein also when actuated by the user, the linear actuator causes the pair of rear pivot links to rotate and pull the pair of seat carrier chassis plates in a down and forward direction thereby pulling seat frame assembly forward; and also further including a seat front guide block and a seat front guide rod attached to the chassis mounting plate so as to provide further support to the seat carrier chassis plate, wherein said seat front guide block and said seat front guide rod are connected by a sliding contact connection.

Also further provided by the current disclosure is the dual motion recline mechanism described supra but wherein also the back assembly includes a back mounting bracket rigidly attached to the seat carrier chassis plate. The dual motion recline may also have the linear actuator operatively connected to a back mounting bracket by a motor drive link.

Also provided by the current disclosure is a seat assembly having a dual motion recline mechanism for a seat assembly including a seat frame assembly wherein said seat frame assembly is configured to pivot to an upright position when unoccupied by a user and to a horizontal down position when occupied by the user; a seat carrier chassis plate operatively connected to said seat frame assembly by pair of seat pivot pins, wherein said seat carrier chassis plate provides support for said seat frame assembly and is configured to allow the movement of said seat frame assembly; a chassis mounting plate connected to said seat frame assembly by rear pivot link and a seat front guide rod; a linear actuator; a pair of rear pivot links wherein each of said pair of rear pivot links is operatively connected at its upper end to said chassis mounting plate, at its center to said seat carrier chassis plate and at its lower end to said linear actuator; and a back frame assembly operatively attached to said seat carrier chassis plate and to said linear actuator, wherein when actuated by the user, said linear actuator seat causes carrier chassis plate to pull back frame assembly downward and forward and wherein also when actuated by the user, said linear actuator causes the pair of rear pivot links to rotate and pull said pair of seat carrier chassis plates in a down and forward direction thereby pulling seat frame assembly forward. The dual motion recline mechanism may have its seat frame assembly rigidly attached to said seat carrier chassis plate or attached by a pivotal connection.

Also provided is that the seat assembly could be a theater seat that may further include a seat member comprising said seat frame assembly, configured to operate in an upright position when unoccupied by a user and in a horizontal down position when occupied by the user; a pair of side panels operatively connected and on opposite sides of said seat member; a back member disposed between and operatively connected to said side panels, wherein said back member comprises back frame assembly and is configured to pivot between a closed upright position and an open reclined position. The seat assembly maybe mounted on a sloped floor or a flat surface by an adjustable leg such as a bolt-on leg, a screw-type leg, a clamp-type leg, a linkage support or a simple threaded leg.

BRIEF DESCRIPTION OF THE DRAWINGS

It being understood that the figures presented herein should not be deemed to limit or define the subject matter claimed herein, the applicants' invention may be understood by reference to the following description taken in conjunction with the accompanying drawings, in which:

FIGS. 5A and 5B depict a configuration where the seat is in the down position and the back member is in the closed and upright position.

DESCRIPTION OF ILLUSTRATIVE EMBODIMENTS

Illustrative embodiments of the invention are described below. In the interest of clarity, not all features of an actual implementation are described in this specification. The following detailed description of exemplary embodiments, read in conjunction with the accompanying drawings, is merely illustrative and is not to be taken as limiting the scope of the invention. Rather, the scope of the invention is defined by the appended claims and equivalents thereof. It will of course be appreciated that in the development of an actual embodiment, numerous implementation-specific decisions must be made to achieve the design-specific goals, which will vary from one implementation to another. Moreover, it will be appreciated that such a development effort, while possibly complex and time-consuming, would nevertheless be a routine undertaking for persons of ordinary skill in the art having the benefit of this disclosure. Further aspects and advantages of the various embodiments of the invention will become apparent from consideration of the following description and drawings. It is noted, however, that the figures are not necessarily drawn to scale.

Figure 1:
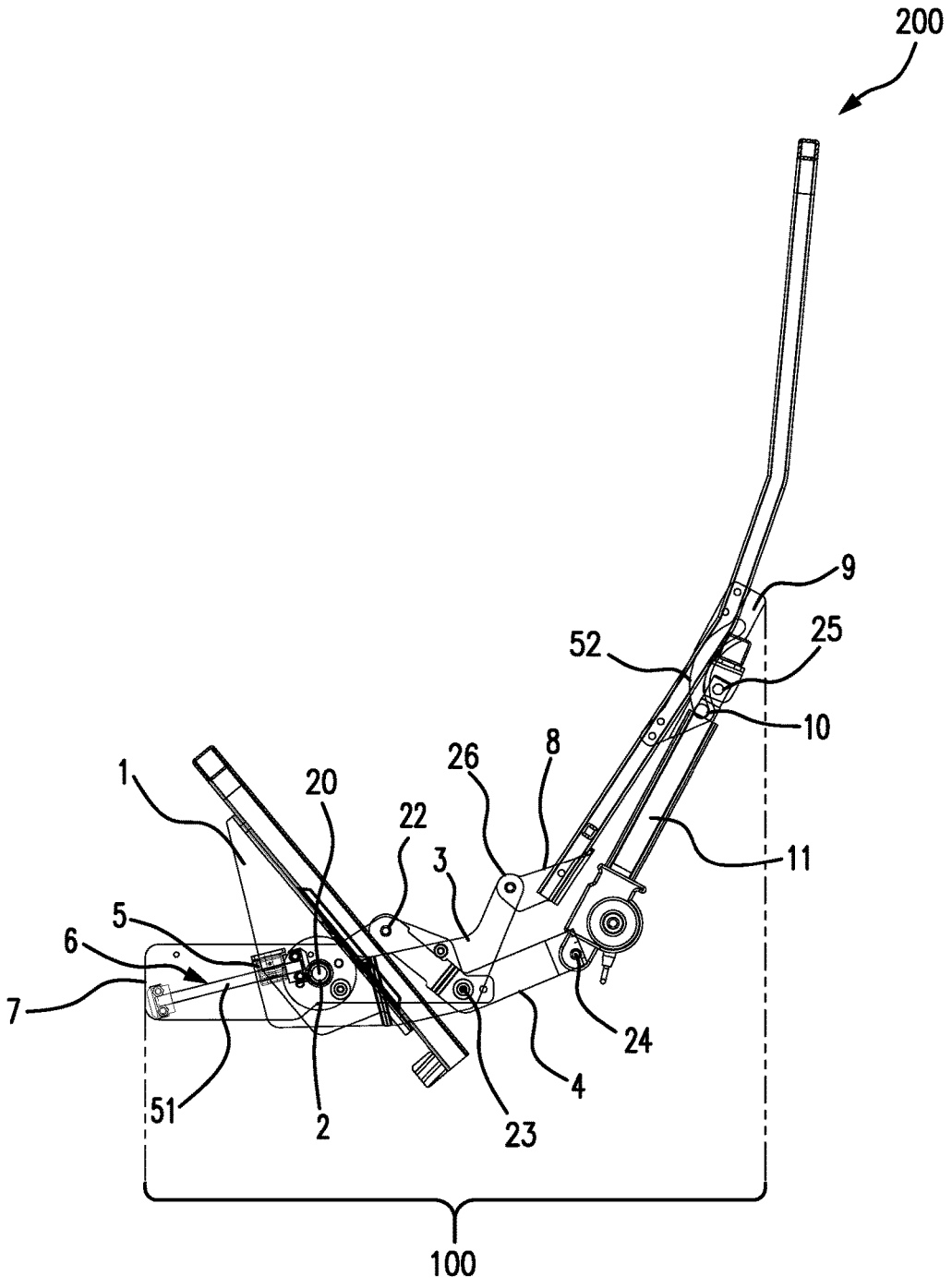
FIG. 1 illustrates a side view of a seat assembly in accordance with the current invention with a recline mechanism, its links and various connection points when the seating member in the up/unoccupied position and the back member in the closed position.
Figure 2:
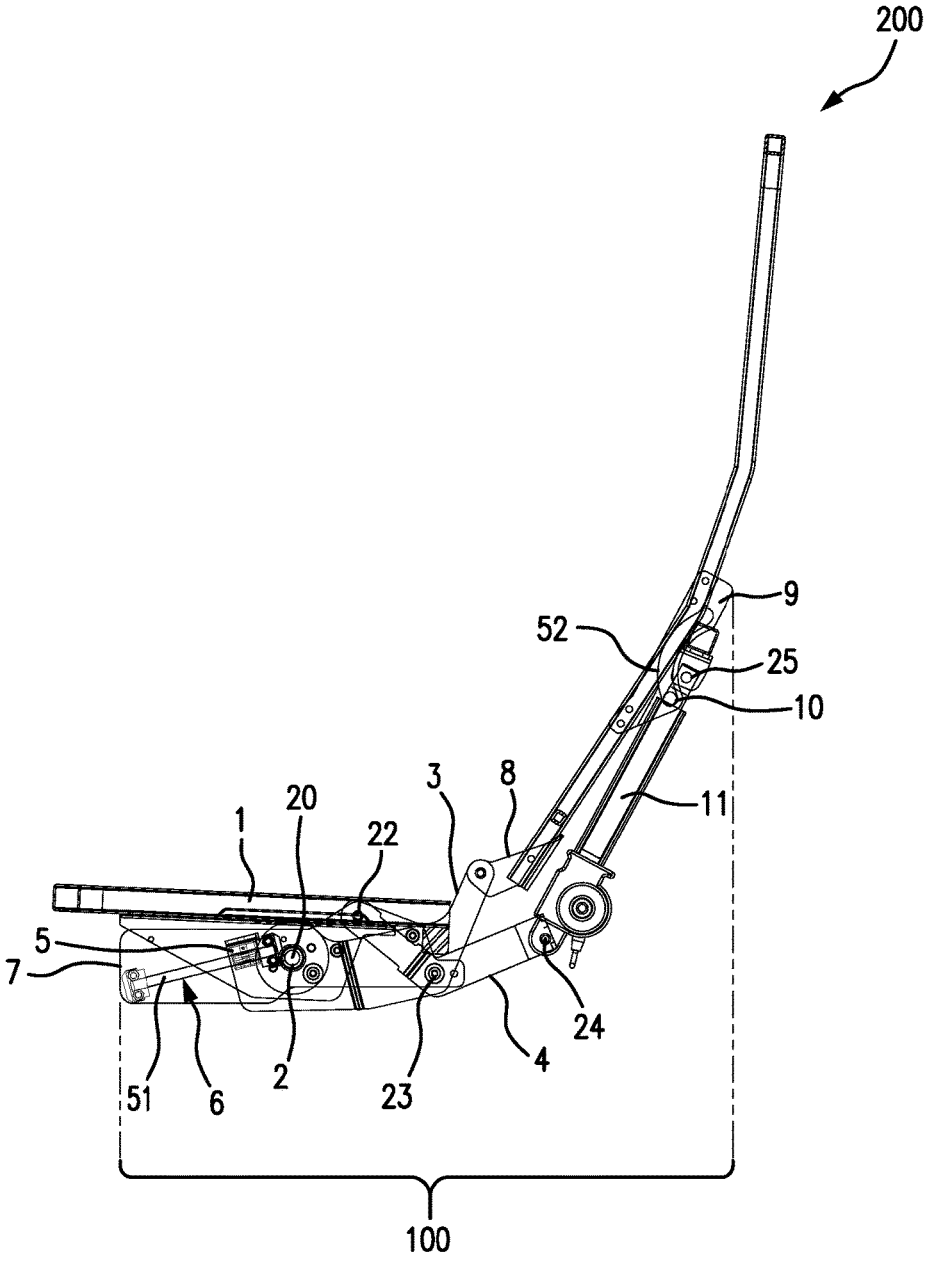
FIG. 2 illustrates a side view of a seat assembly in accordance with the current invention with a recline mechanism, its links and various connection points when the seating frame assembly is in the down/occupied position and the back frame assembly is in the closed position.
Figure 3:
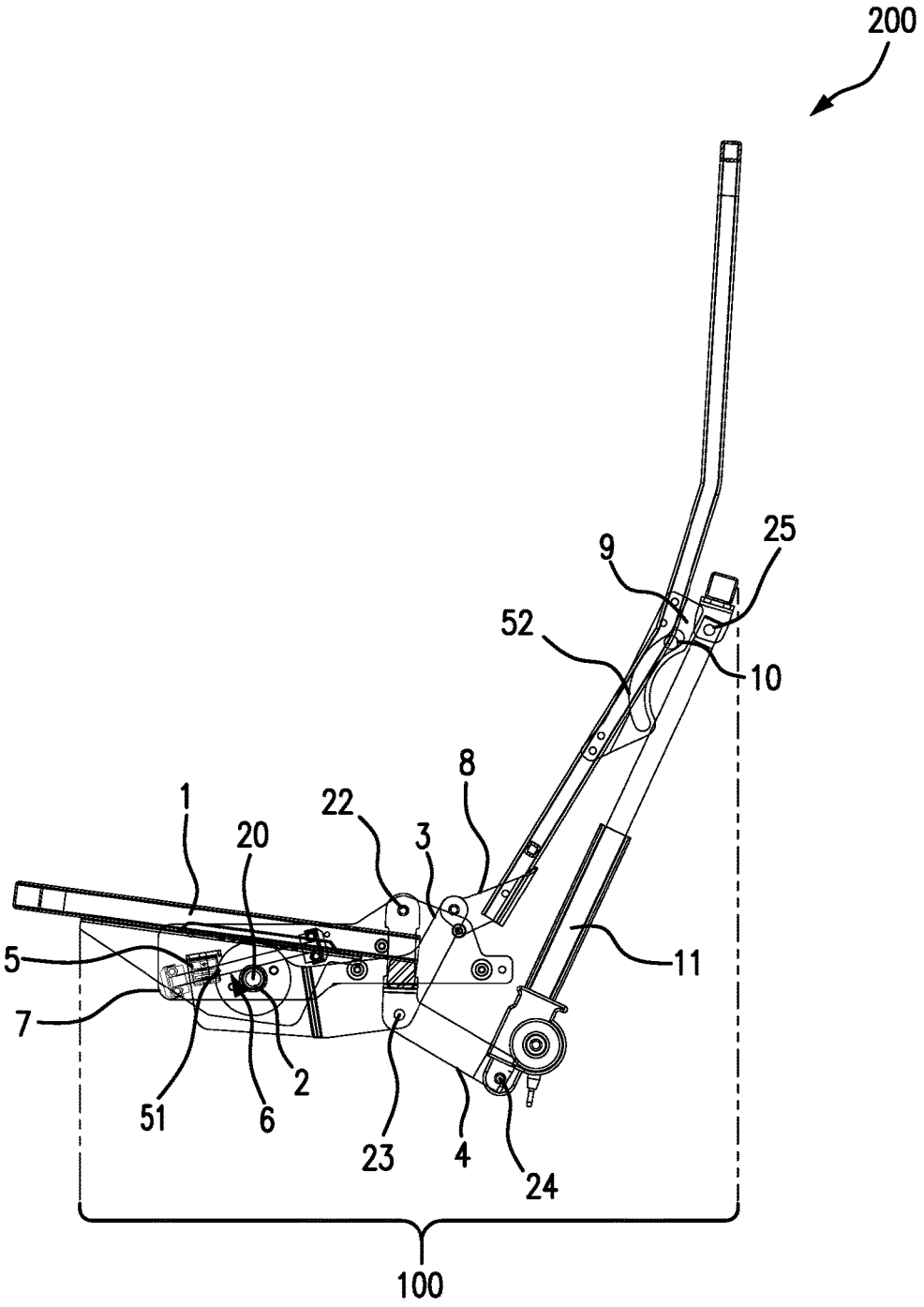
FIG. 3 illustrates a side view of a seat assembly in accordance with the current invention with a recline mechanism, its links and various connection points when the seating frame assembly is in the down/occupied position and the back frame assembly is in full recline position and the linear actuator is fully actuated.

Embodiments of the present disclosure provide for a dual motion sloped floor recline mechanism 100 and a seating assembly 200 comprising the same. Unlike embodiments of the prior art, the dual motion recline mechanism of the present invention pairs a seat frame assembly 1 with a back reclining frame assembly 8 such that the seat frame assembly is nested within the recline frame assembly. With this pairing, the seat assembly provides additional comfort by having the back recline concurrently as the seat moves forward. Such a combination is unique and is not present in prior art chairs. Shown, in FIG. 1, is seat assembly 200 in the seat up, closed position and its associated recline mechanism/linkage system, with its various links and connection points. FIG. 2 depicts seat assembly 200 in the seat down closed position and FIG. 3 illustrates a seat down full recline configuration.

Referring to FIGS. 1-4F, seat assembly 200 includes various linkages and connection points as also explained and shown in Tables 1 and 2. It is to be understood by a person of skill in the art, that other elements may also be added to the recline mechanism shown in these figures and such elements would also fall within the scope of the current disclosure. Seat assembly 200 includes seat frame assembly 1, which tilts about a set of seat pivot pins 2, and back frame assembly 8 connected by seat carrier chassis plate 3. Seat frame assembly 1 and carrier chassis plate 3 are connected only at pivot 1 which is between seat pivot pin 2 held by carrier chassis plate 3. Pivot 1 is a connection point between seat frame assembly 1 and seat pivot pin 2. Seat carrier chassis plate 3 is controlled by an arrangement of components including seat front guide block 5 and a set of seat front guide rods 6. A sliding contact (CAM) connection 51 (Control Surf. 1) attaches seat front guide block 5 and seat front guide rod 6. Shown in these figures, seat front guide blocks 5 are rigidly affixed to seat carrier chassis plate 3 and guide rods 6 are rigidly affixed to set of chassis mounting plates 7. However, other types of connections or linkages may also be used. Rear pivot links 4, at its center, is attached to seat carrier chassis plate 3, at its upper end to chassis mounting plate 7 and at its lower end to linear actuator 11 (could be a motor or gas cylinder, or other types of actuators). Seat carrier chassis plate 3 is connected to rear pivot link 4 by pivotal connection point 23 (shown as pivot 3) Chassis mounting plate 7 is shown pivotally connected to rear pivot link 4 by pivot 2 (22). Pivot 4 (24) connects rear pivot link 4 and linear actuator 11.

The current invention also contemplates embodiments where seat frame assembly (1) and seat carrier chassis plate 3 are rigidly attached to each other. Such an embodiment may be more cost effective. In embodiment 1, FIGS. 1-4F, the control of the top section of back frame assembly 8 is by back frame guide block 9 and back guide pin 10. In embodiment 2 (shown in FIGS. 5-12), back frame guide block 9 and back guide pin 10 are not present because in this embodiment back frame assembly 8 is rigidly fixed to seat carrier chassis plate 3 and therefore does not need a control mechanism.

The current invention also contemplates embodiments wherein the control surface comprising seat front guide rod 6 and seat front guide block 5 are replaced or supplemented with an arrangement of linkages to control the front section of seat carrier chassis plate 3.

Figure 7:
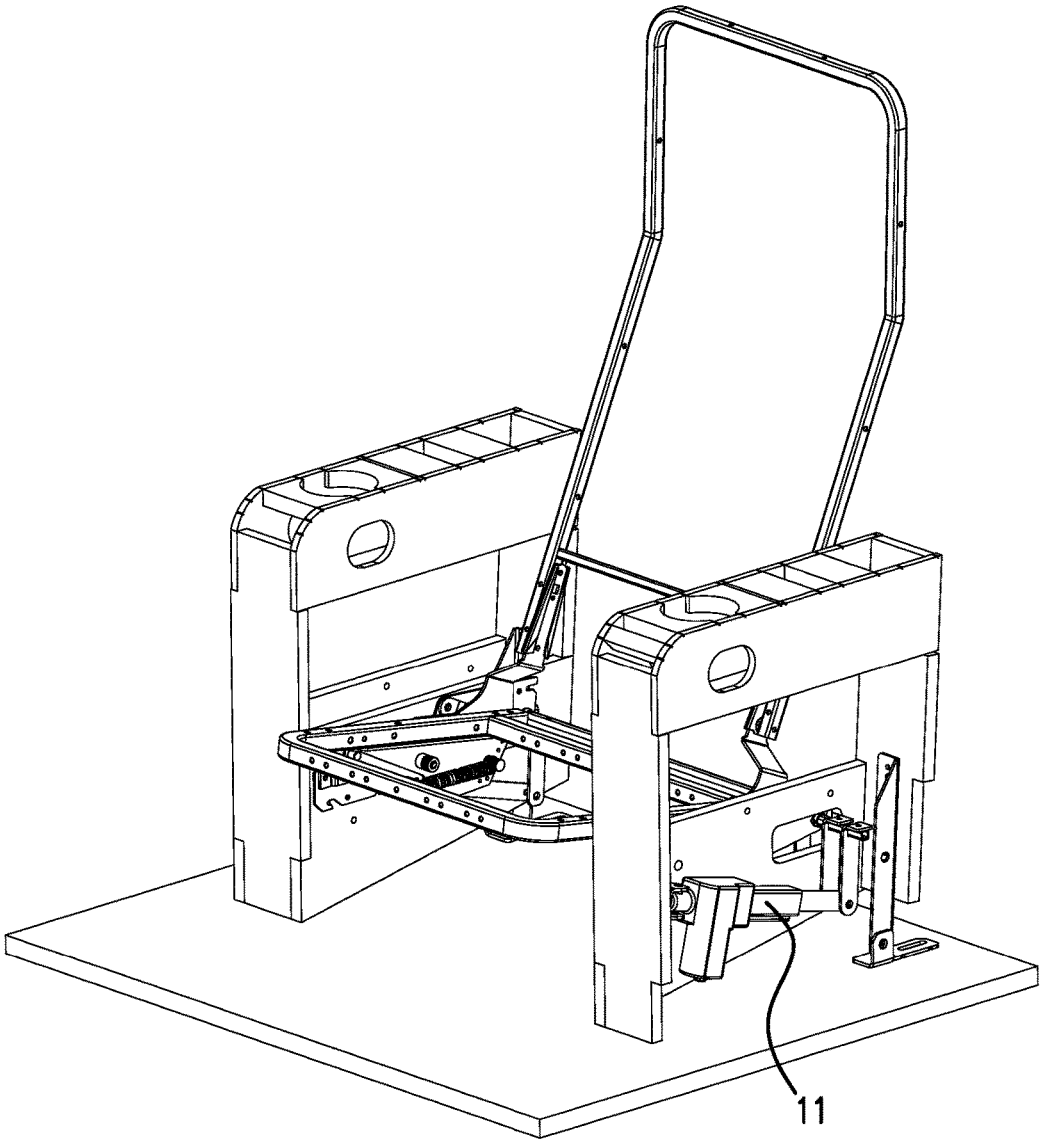
FIG. 7 is an illustration of a seating assembly in accordance with the current disclosure, depicting the location of the recline mechanism relative to the seating assembly. In this embodiment, the motor or control unit (such as a linear actuator or a gas cylinder for example) is situated under the arm rest.
Figure 8:
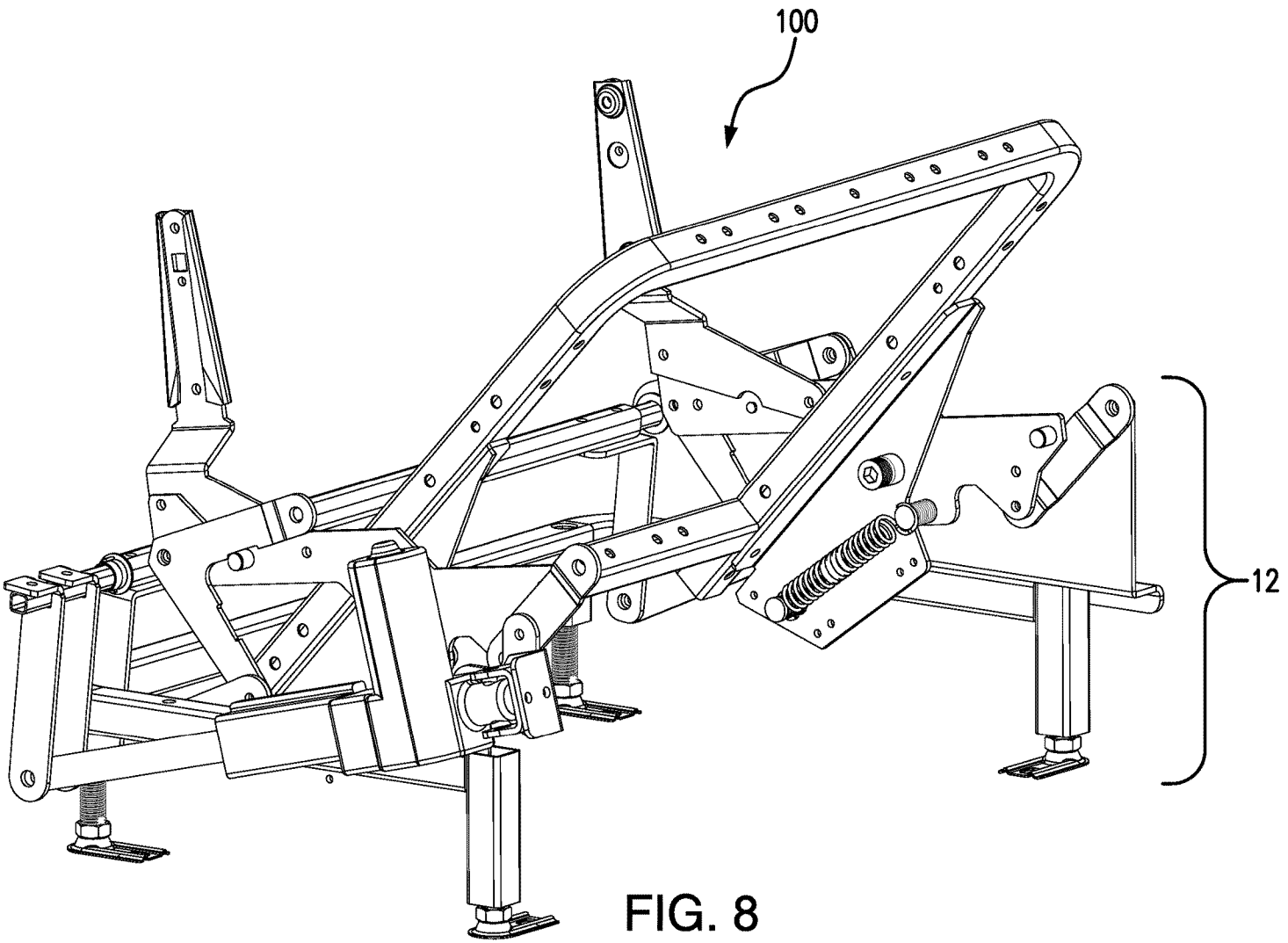
FIG. 8 is a 3-D illustration of a recline mechanism/linkage system in accordance with the current disclosure.
Figure 9B:
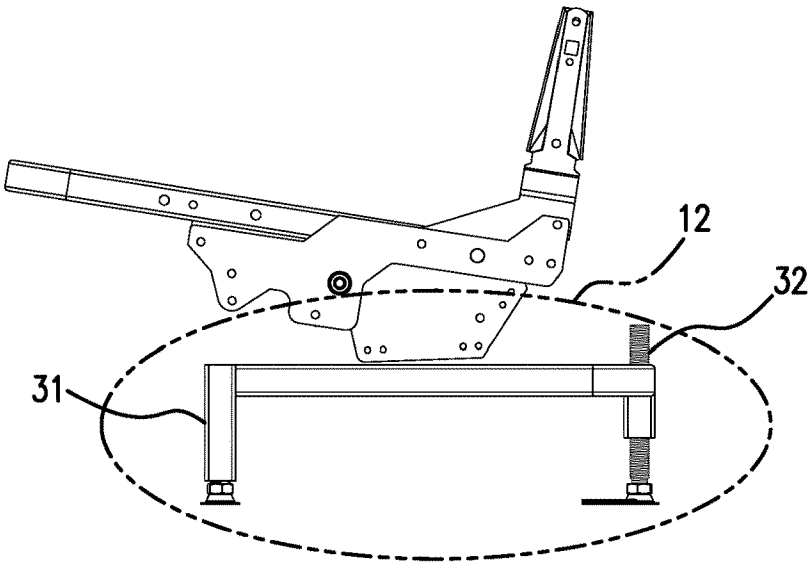
FIGS. 9A-9D illustrate side views the links of the recline mechanism in accordance with the current disclosure involved in the seat going from an unoccupied (up) position to a down/occupied position.
Figure 9A:
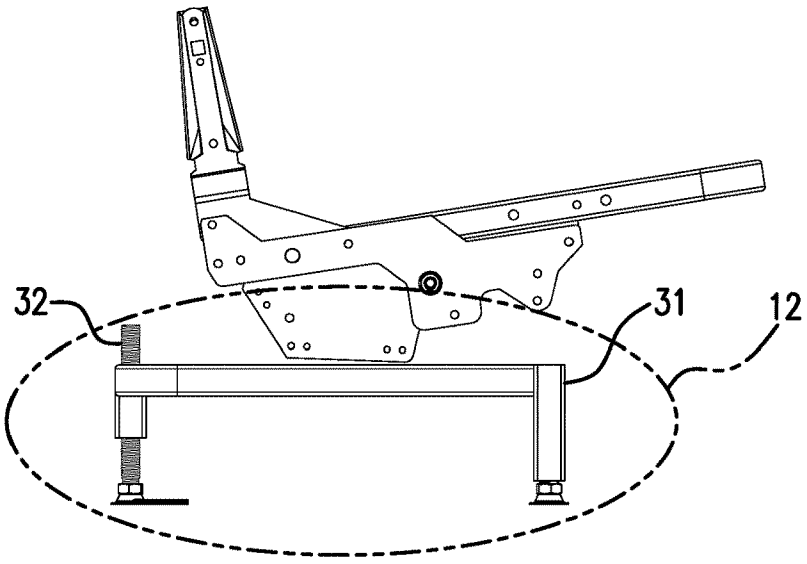
Figure 9D:
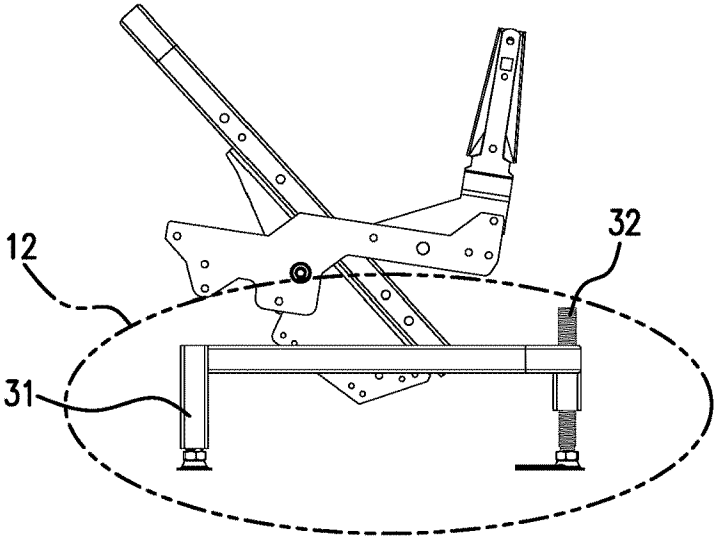
Figure 9C:
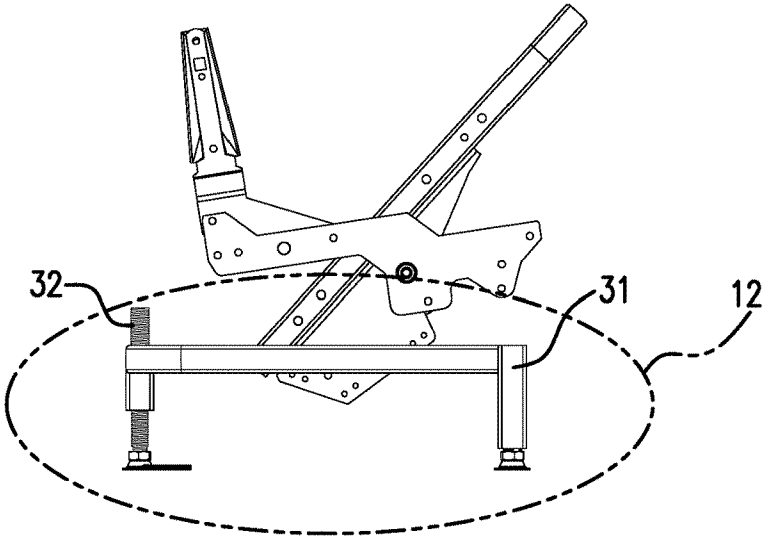

One unique aspect of embodiments shown in FIGS. 1 and 7, for example, is the remote placement of the motor/linear actuator 11. Prior art recliners have a motor situated under the seat. Prior art design(s) are not well-suited for a theater seat, or any other type of seat assembly that is to be used in limited space. Embodiments showing the remote placement of linear actuator 11 are shown in FIGS. 1-3 and 7 for example. However, it is understood by a person of skill in the art that other locations and attachment points for a motor/actuator may also be used and that would also fall within the scope of the current disclosure. The top of linear actuator 11 is shown here attached to the fixed frame which through several brackets, not shown but are well understood by a person of skill in the art, is attached rigidly to chassis mounting plate 7. The remote placement of the motor allows the possible hybrid between a reclining back member and a seat member that tilts or pivots. Elements 3, 4, are driven remotely according to the current disclosure. Rear pivot link 4 is placed in a particular location, as shown in FIGS. 1-3 that would allow attaching the actuator to pivot 4.

Figure 4B:
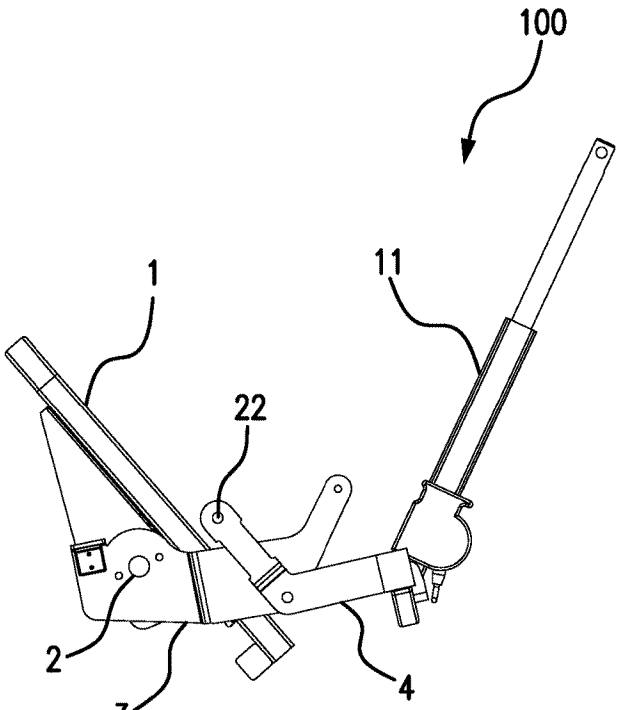
FIGS. 4A-4F illustrate front and side views of the recline mechanism of the current disclosure and its various links and connections in all three configurations-seat up/back closed (FIGS. 4A and 4B), seat down/back closed (FIGS. 4C and 4D) and seat down/back in full recline (FIGS. 4E and 4F).
Figure 4A:
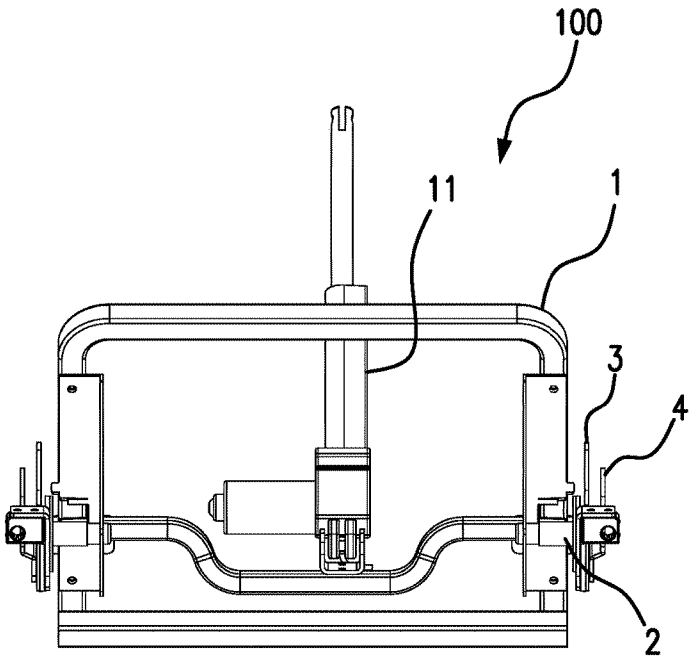
Figure 4D:
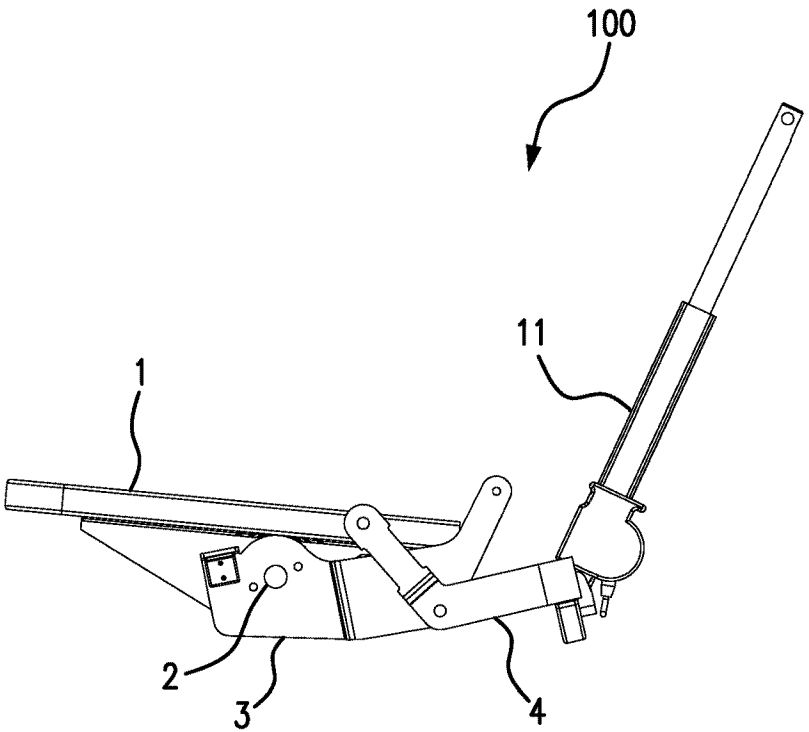
Figure 4C:
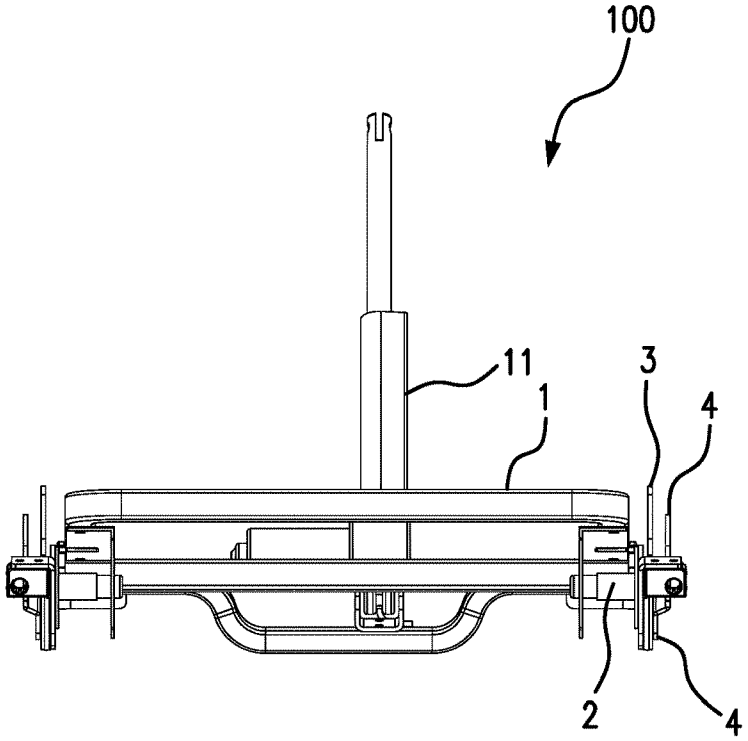
Figure 4F:
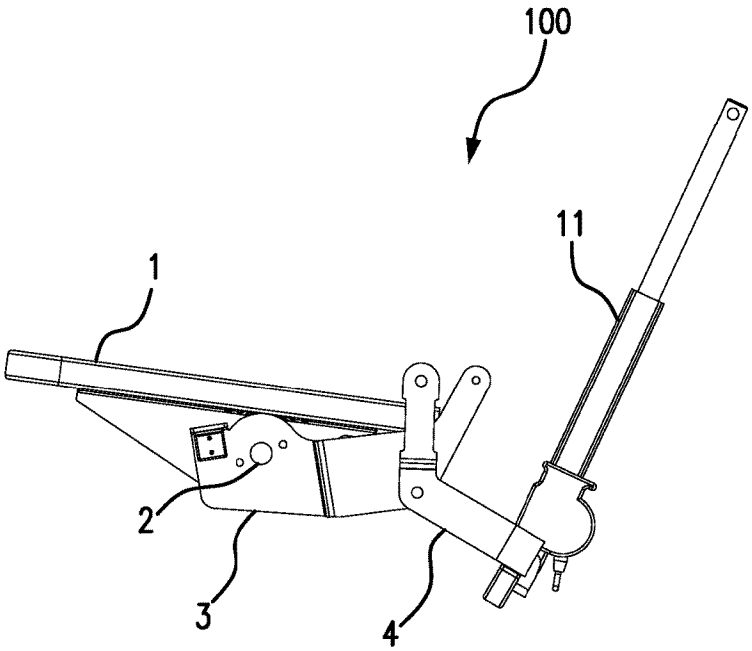
Figure 4E:
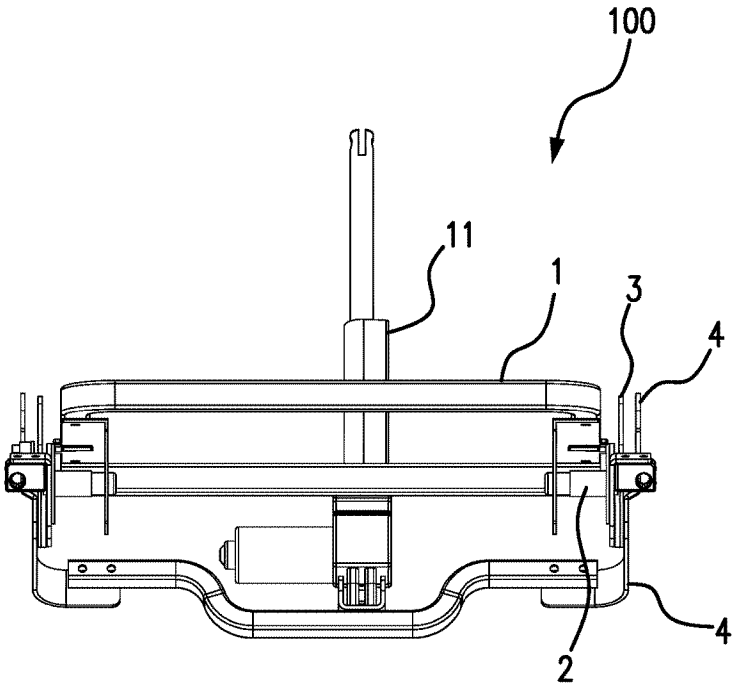

FIGS. 4A-4F illustrate front and side views of the recline mechanism of the current disclosure and its various links and connections in all three configurations-seat up/back closed (FIGS. 4A and 4B), seat down/back closed (FIGS. 4C and 4D) and seat down/back in full recline (FIGS. 4E and 4F). All elements function as described in Table 1 with connection points outlined in Table 2.

Figure 5B:
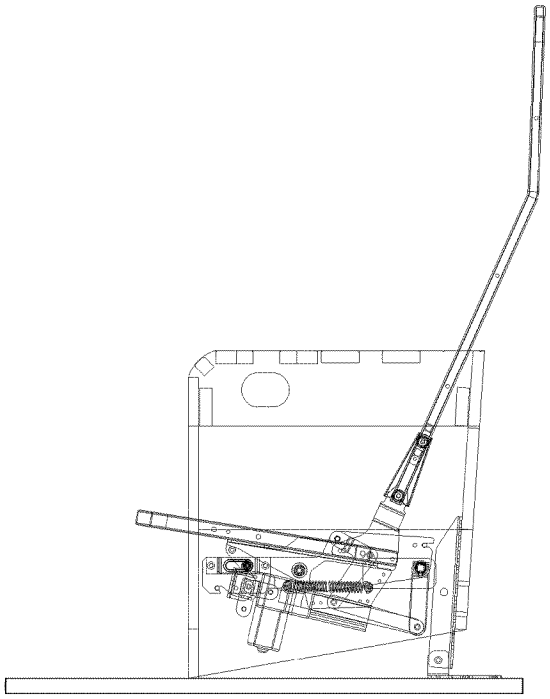
FIGS. 5A and 5B are illustrations of front and side views of one embodiment of a seating assembly according to the current disclosure having a linear actuator situated under an arm rest.
Figure 5A:
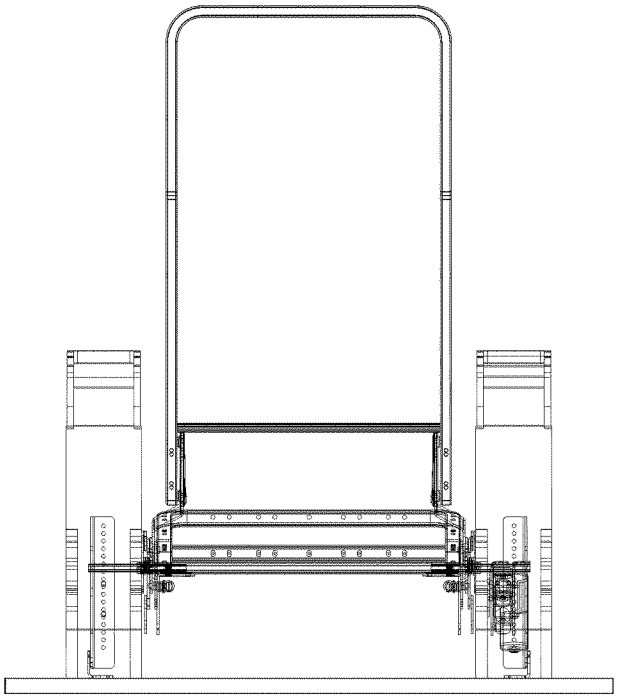

FIGS. 5A and 5B are illustrations of front and side views of one embodiment, referred to as embodiment 2, of a seating assembly according to the current disclosure having a linear actuator situated under an arm rest. FIGS. 5A and 5B depict a configuration where the seat is in the down position and the back member is in the closed and upright position.

Figure 6B:
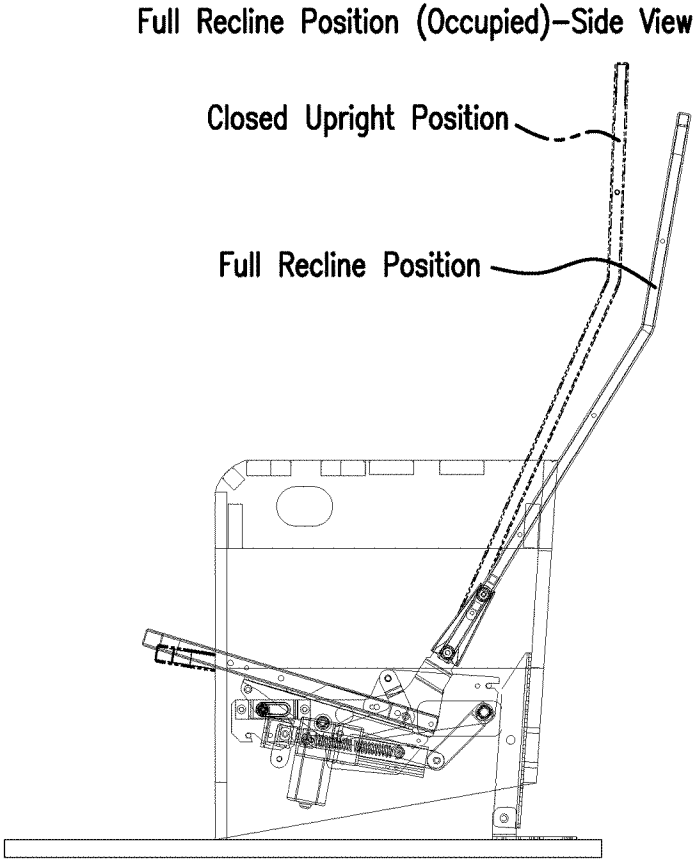
FIGS. 6A and 6B are illustrations of front and side views of the seat in FIGS. 5A and 5B, wherein the back member is in a full recline position and the seating member is in the down/occupied position, illustrative of a dual motion recline mechanism.
Figure 6A:
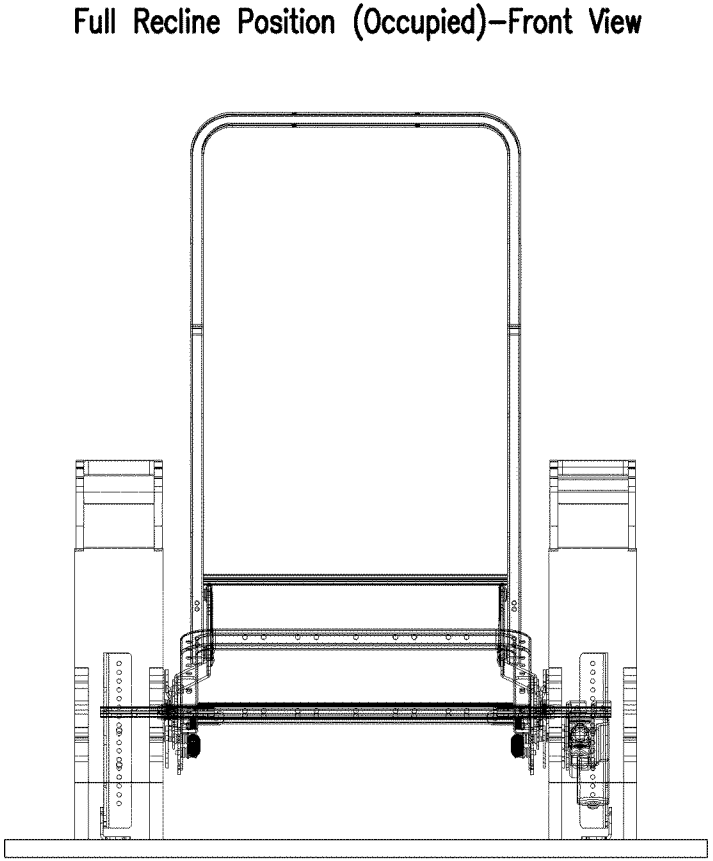

As described supra, the remote placement of a linear actuator away from seat member assembly 1, allows the concurrent dual seat tilting and back recline features of a seating assembly in accordance with the current invention. Such a seating assembly is also depicted in FIGS. 6A, 6B, FIG. 7 and FIG. 12. The motor or control unit can be a linear actuator 11 or a gas cylinder for example. FIGS. 6A and 6B are illustrations of front and side views of the seat in FIGS. 5A and 5B, wherein the back member is in a full recline position and the seating member is in the down/occupied position, illustrative of a dual motion recline mechanism.

In reference to FIGS. 8-12, a user approaches a normal unoccupied chair where the seat is in an upright (space saving position). This is achieved by the use of a counterweight, spring or gas cylinder. The recline actuator will be in the extended position which holds the recline linkage 100 in the upright or closed position. Normally an occupant approaches a seats and tilts it to the down position. After seating, the occupant may operate a switch or lever to activate the motor or gas cylinder to allow the motor or gas cylinder to retract. This pulls the motor drive link forward and pushes the rear pivot link to the open or reclined position 18. Once the occupant exits the seat, the seat returns to the original upright position.

Figure 10C:
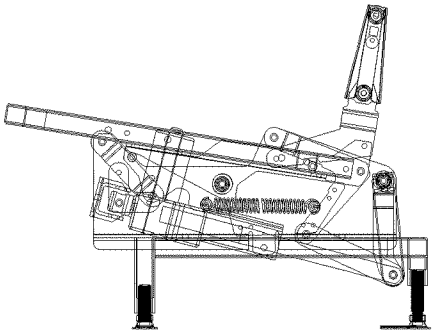
FIG. 10C shows a left side view of a seat down, recline closed configuration of the recline mechanism.
Figure 10B:
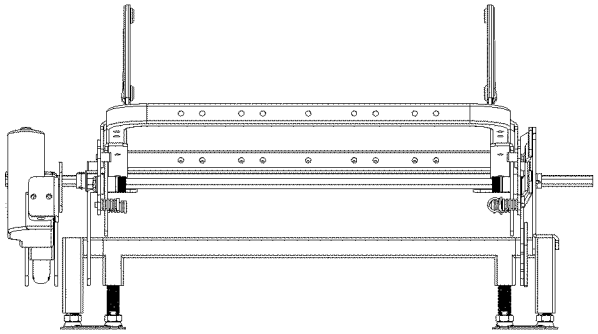
FIG. 10B shows a front view of a recline mechanism.
Figure 10A:
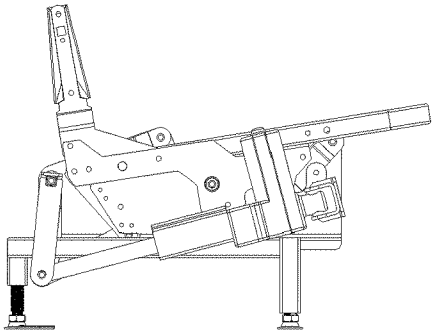
FIG. 10A shows a recline mechanism in the seat down recline closed position configuration of the recline mechanism.
Figure 10E:
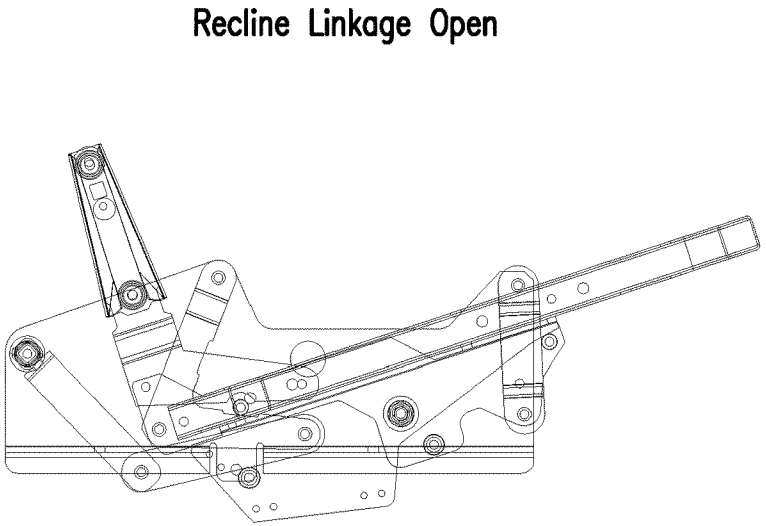
FIG. 10E illustrates a motor retracted, open recline linkage.
Figure 10D:
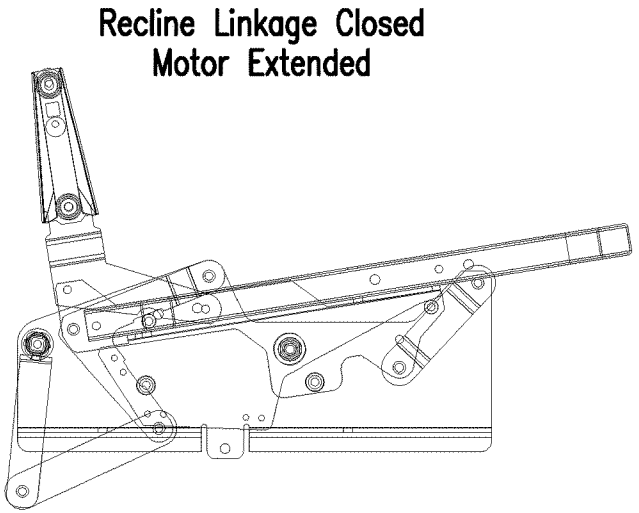
FIG. 10D illustrates a motor extended, closed recline linkage.
Figure 11:
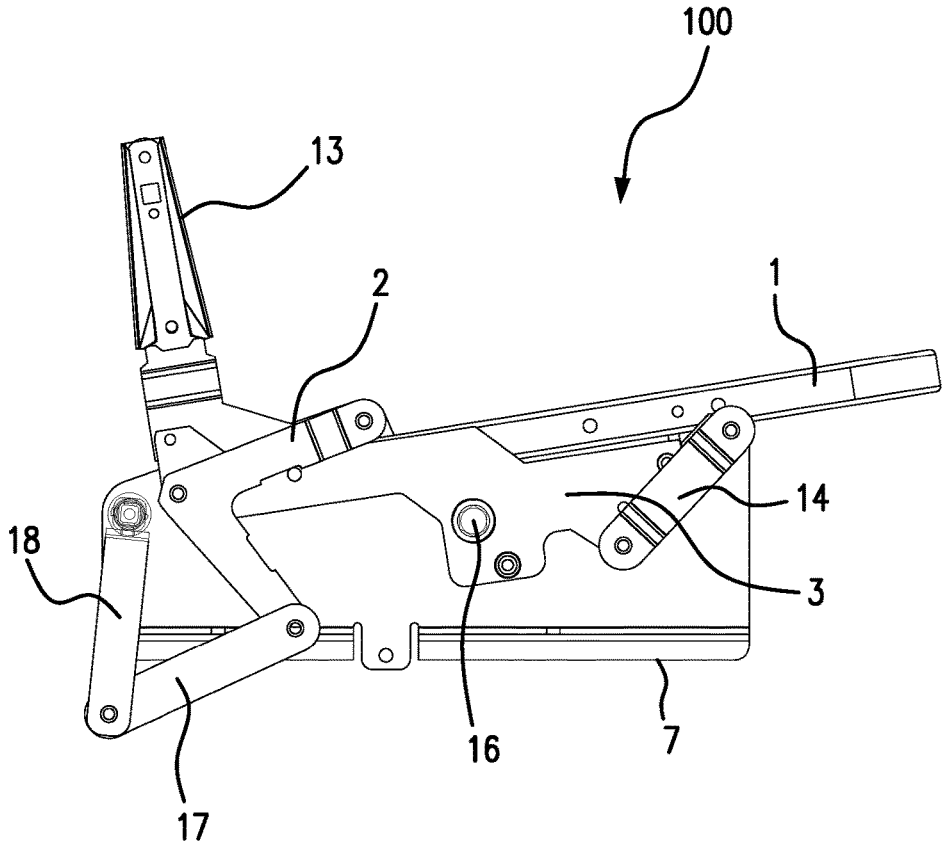
FIG. 11 illustrates a recline mechanism and its various pivotally interconnected parts.

FIGS. 9A-9D illustrate side views the links of the recline mechanism in accordance with the current disclosure involved in the seat going from an unoccupied (up) position to a down/occupied position. The force exerted to raise the seat is by a counterweight spring, for example, or a gas cylinder. This motion is automatic and raises the seat when there is no occupant in the seat section. The weight of the occupant keeps the seat in the down position. FIG. 10A shows a recline mechanism in the seat down recline closed position configuration of the recline mechanism. FIG. 10B shows a front view of a recline mechanism. FIG. 10C shows a left side view of a seat down, recline closed configuration of the recline mechanism. FIG. 10D illustrates a motor extended, closed recline linkage. FIG. 10E illustrates a motor retracted, open recline linkage. FIG. 11 illustrates a recline mechanism and its various pivotally interconnected parts.

Referring to FIGS. 1-12, operation of the Dual Motion Sloped Floor Recline Mechanism will now be described. The connection and arrangement of the tilt-up seat frame assembly (1), mechanism linkage side assemblies, linear actuator (11), back frame assembly (8), and fixed base (12), as described above, enables the occupant to adjust the position of the seat and back frame. Starting from the seat up, closed recline position as in FIGS. 4A-4B, seat frame assembly 1 would be tilted upward as in a non-occupied position. For the first motion of the dual motion claim, the occupant applies force to the top-front of the seat assembly 1, thereby tilting the seat assembly 1 about a set of seat pivot pins 2 until the seat assembly 1 reaches the seat down position as shown in FIGS. 4E and 4F. For the second motion of the dual motion claim, the occupant can then activate the linear actuator 11 which is in the fully retracted position at the start. The linear actuator 11 drives a point pivot 4 (reference no. 24), which is the connection point between the linear actuator 11 and a set of rear pivot links 4, in a down and forward direction. Rear pivot links 4 rotate about point pivot 2 which is the attachment point for connecting a set of pivot links 4 to set of chassis mounting plates 7. This action drives point pivot 3 (reference no. 23), which is the connection point between said set of rear pivot links 4 and said set of seat carrier chassis plates 3, in a down and forward direction. This motion of the set of rear pivot links 4 serves to control the rear section of the said set of seat carrier chassis plates 3 which in turn controls the motion of the rear of the seat frame assembly. The front section of the seat carrier chassis plates 3 are controlled by an arrangement of several components including a set of seat front guide blocks 5, which are rigidly attached to said set of seat carrier chassis plates 3, and a set of seat front guide rods 6, which are rigidly attached to a set of chassis mounting plates 7. This arrangement serves to control the front section of said seat carrier chassis plate 3 which in turn controls the front section of the seat frame assembly 1.

Figure 12:
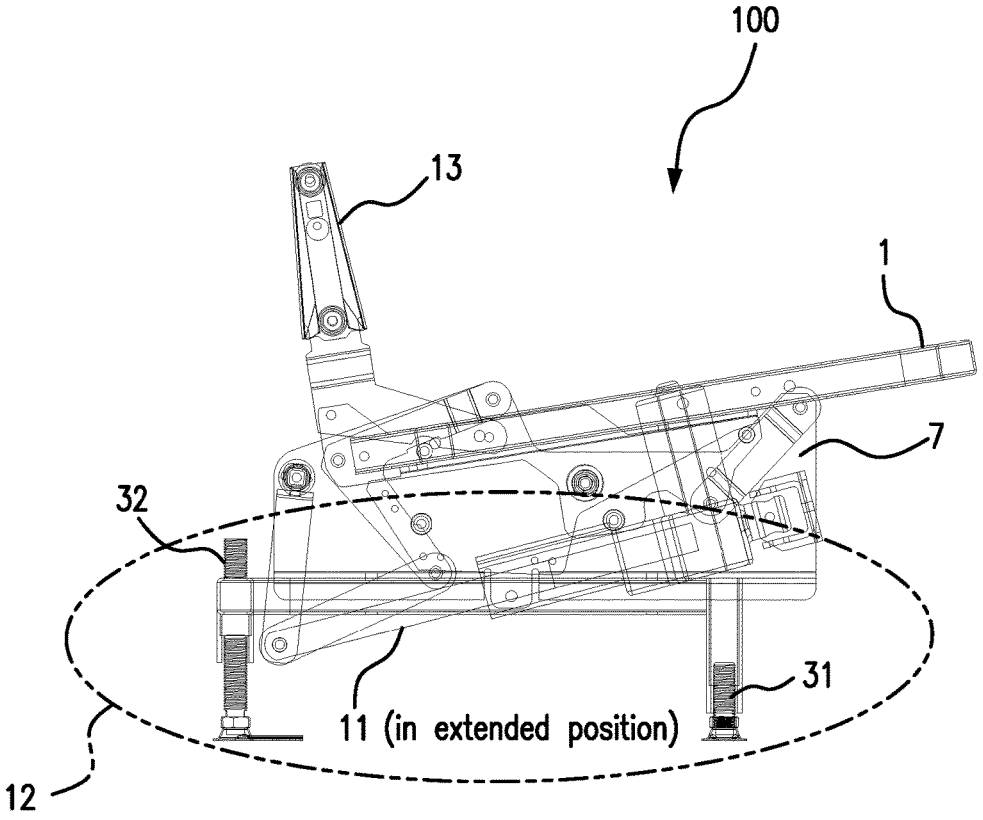
FIG. 12 illustrates a recline mechanism/linkage system of an embodiment of the current disclosure where a linear actuator situated below the arm rest.

The control of the back frame assembly 8 is dependent on the motion of point pivot 6, which is the connection point for the back frame assembly 8 and the set of seat carrier chassis plates 3. When transitioning from the closed to recline position, point pivot 6 pulls the back frame assembly 8 downward and forward thereby changing the position of the back frame assembly 8. As the lower section of back frame assembly 8 is being pulled downward and forward by the motion of the set of seat carrier chassis plates 3, the upper section of the back frame assembly 8 is controlled by an arrangement of a set of back guide pins 10, which are rigidly attached to the fixed base, and a set of back frame guide blocks 9, which are rigidly attached to back frame assembly 8. (This is a typical cam and follower arrangement.) The description of the motion of the Dual Motion Sloped Floor Recline Mechanism supra describes the positions in order from seat up, closed recline, to seat down, closed recline then to seat down, fully recline position An aspect of the recline mechanism of the current disclosure is that it can be mounted on a slope with varying degrees, an advantageous feature for installing seats in a movie theater, for example. Adjustable back 32 and front 31 legs can be mounted on the chassis mounting plate as shown in FIGS. 9, 10, and 12. The back 32 and front 31 legs can be separately adjusted to complement any back or front floor elevation. A recline mechanism for a seat assembly comprises a seat frame, a seat carrier chassis plate operatively connected to the seat frame by a pivot point 16, a back mounting bracket operatively connected to the seat carrier chassis plate, a chassis mounting plate connected to the seat frame by a front pivot link 14, and a rear pivot link which is connected to a motor drive link 18 by a connector link 17 and a motor 11 that operates the recline mechanism for the back mounting bracket by means of a motor drive link 18. Other recliner mechanisms include "metal to the floor" linkage which usually incorporates a single link to serve as a pivot link. Several are simply 4-bar linkages having a seat, base, front pivot and rear pivot. To gain the vertical compactness necessary to use the mechanism on a sloped floor, the single link rear pivot is replaced with an arrangement of links which act to control the rear of the seat. this allows the vertical height to be more compact in the open or recline position. This creates the clearance necessary to mount the char on a sloped floor.

TABLE 1

Description of various elements of the dual motion linkage system (recline mechanism)

| Embodiment* | REFERENCE NO. | DESCRIPTION | FUNCTION | Number of parts per seat assembly |
|---|---|---|---|---|
| 1 and 2 | 1 | SEAT FRAME ASSEMBLY | Provide support for a seat member | 1 |
| 1 and 2 | 2 | SEAT PIVOT PIN | Allows tilting of seat member | 2 |
| 1 and 2 | 3 | SEAT CARRIER CHASSIS PLATE | Unique part. Makes combination of recliner and theater seat in one hybrid seat assembly possible. Allows a Flip up and recline motion mechanism. | 1 |
| 1 and 2 | 4 | REAR PIVOT LINK | Links the three elements, 3, 7 and 11. At its upper end, 4 links 7, at its center portion it links to link 3 at pivot 3, and the end, it links to motor 11 at pivot 4. This combination is novel and allows the remote location of the motor away from the flip up seat. | 2 |
| 1 and 2 | 5 | SEAT FRONT GUIDE BLOCK | Controls the front section of seat carrier chassis plate 3 by following sliding contact surface of seat front guide rod.. guide block and sliding contact with rod can control front of seat carrier chassis plate or linkage can be used. | 2 |
| 1 and 2 | 6 | SEAT FRONT GUIDE ROD | Controls the front of seat carrier chassis plate 3 by being the sliding contact surface for seat front guide block 5 | 2 |
| 1 and 2 | 7 | CHASSIS MOUNTING PLATE | Provides a fixed location on 12 for mounting seat front guide rod 6 and rear pivot link 4. | 2 |
| 1 and 2-either embodiment may use this articulating back or may have the back frame assembly 8 rigidly attached to seat carrier chassis plate 3. | 8 | BACK FRAME ASSEMBLY | Support structure for seating back section. Pivotally connected at lower end to seat carrier chassis plate 3 and controlled at the upper section by sliding contact between back frame guide block 9 (rigidly attached to 8) and back guide pin 10 (rigidly attached to base 12 | 1 |
| 1 and 2-either embodiment. Rigidly attaching the back frame 8 to the seat carrier chassis plate 3 would negate the use of 9 | 9 | BACK FRAME GUIDE BLOCK | Rigidly attached to Back Frame Assembly 8 and acts as the guide surface for sliding contact between itself and Back Guide Pin 10. | 2 |
| 1 and 2-rigidly attaching the back frame 8 to 3 would negate the need for 10 | 10 | BACK GUIDE PIN | Rigidly attached to base 12 and acts as the follower surface for sliding contact surface between itself and back frame guide block 9 | 2 |
| 1 and 2 | 11 | LINEAR ACTUATOR | . Remotely driven actuator of linkage system | 1 |
| 1 and 2 | 12 | base | Non-moving section | 1 |
| 1 and 2 | 13 | Back mounting bracket | | 1 |
| 1 and 2 | 100 | Recline mechanism (Linkage system) | Entire linkage system that allows seat and back movements | 1 |
| 1 and 2 | 200 | Seat assembly | reclining chair | 1 |

*1 = Embodiment with motor behind back assembly. 2 = Embodiment with motor under armrest

TABLE 2

| Connection Points between the various elements of the linkage system according to the current invention | | |
|---|---|---|
| Reference No. | Connection | Description |
| 20 | Pivot 1 | PIVOTAL CONNECTION BETWEEN SEAT FRAME ASSEMBLY (1) AND SEAT PIVOT PIN (2) |
| 22 | Pivot 2 | PIVOTAL CONNECTION BETWEEN REAR PIVOT LINK (4) AND CHASSIS MOUNTING PLATE (7) |
| 23 | Pivot 3 | PIVOTAL CONNECTION BETWEEN SEAT CARRIER CHASSIS PLATE (3) AND REAR PIVOT LINK (4) |
| 24 | Pivot 4 | PIVOTAL CONNECTION BETWEEN REAR PIVOT LINK (4) AND LINEAR ACTUATOR (11) |
| 25 | Pivot 5 | PIVOTAL CONNECTION BETWEEN LINEAR ACTUATOR (11) AND BASE (NON MOVING SECTION) |
| 26 | Pivot 6 | PIVOTAL CONNECTION BETWEEN FRAME ASSEMBLY 8 AND THE SET OF SEAT CARRIER CHASSIS PLATES 3 |
| 51 | Control Surf. 1 | SLIDING CONTACT (CAM) CONNECTION BETWEEN SEAT FRONT GUIDE BLOCK (5) AND SEAT FRONT GUIDE ROD (6) |
| 52 | Control Surf. 2 | SLIDING CONTACT (CAM) CONNECTION BETWEEN BACK FRAME ASSEMBLY (9) AND BACK GUIDE PIN (10) |

It will be understood by one of ordinary skill in the art that in general any subset or all of the various embodiments and inventive features described herein may be combined, notwithstanding the fact that the claims set forth only a limited number of such combinations.

What is claimed is:

1. A dual motion recline mechanism for a seat assembly comprising:

a seat frame assembly wherein said seat frame assembly is configured to pivot between an upright position and a horizontal down position;

a seat carrier chassis plate operatively connected to said seat frame assembly by a pair of seat pivot pins, wherein said seat carrier chassis plate provides support for said seat frame assembly and is configured to allow the movement of said seat frame assembly;

a seat front guide rod;

a chassis mounting plate, wherein said chassis mounting plate is connected to said seat frame assembly by said seat front guide rod;

a linear actuator;

a pair of rear pivot links wherein each of said pair of rear pivot links is operatively connected to said chassis mounting plate via an upper end of each of said pair of rear pivot links, to said seat carrier chassis plate via a center of each of said pair of rear pivot links and to said linear actuator via a lower end of each of said pair of rear pivot links; and a back frame assembly operatively attached to said seat carrier chassis plate and to said linear actuator, wherein said linear actuator is configured to allow said seat carrier chassis plate to pull said back frame assembly downward and forward and to allow said pair of rear pivot links to rotate and pull said seat carrier chassis plate in a down and forward direction thereby pulling said seat frame assembly forward; and wherein said chassis mounting plate is further connected to said seat frame assembly by said pair of rear pivot links.

2. The dual motion recline mechanism of claim 1, wherein said seat frame assembly is connected to the said seat carrier chassis plate by a pivotal connection.

3. The dual motion recline mechanism of claim 1, wherein said back frame assembly is attached to said seat carrier chassis plate by a pivotal connection.

4. The dual motion recline mechanism of claim 1, wherein said linear actuator is situated behind said back frame assembly.

5. The dual motion recline mechanism of claim 1, wherein said linear actuator is situated under an arm rest attached to said seat assembly.

6. The dual motion recline mechanism of claim 1, wherein said linear actuator is attached to said pair of rear pivot links.

7. The dual motion recline mechanism of claim 1, further comprising a seat front guide block attached to said chassis mounting plate so as to provide further support to said seat carrier chassis plate, wherein said seat front guide block and said seat front guide rod are connected by a sliding contact connection.

8. The dual motion recline mechanism of claim 1, wherein the back frame assembly comprises a back mounting bracket attached to the seat carrier chassis plate.

9. The dual motion recline mechanism of claim 1, wherein said linear actuator is operatively connected to a back mounting bracket by a motor drive link.

10. A seat assembly comprising the reclining mechanism of claim 1.

11. The seat assembly of claim 10, wherein said seat assembly is a theater seat.

12. The seat assembly of claim 10 further comprising:

a seat member comprising said seat frame assembly, configured to operate between an upright position and a horizontal down position;

a pair of side panels operatively connected to and on opposite sides of said seat member;

a back member disposed between and operatively connected to said pair of side panels, wherein said back member comprises said back frame assembly and is configured to pivot between a closed upright position and an open reclined position.

13. The seat assembly of claim 10, wherein said seat assembly is configured to be mounted on a sloped floor.

14. The seat assembly of claim 13, further comprising an adjustable leg allowing said seat assembly to be mounted on a sloped floor.

15. The seat assembly of claim 14, wherein said adjustable leg is a bolt-on leg, a screw-type leg, a clamp-type leg, a linkage support or a threaded leg.

16. The seat assembly of claim 10, wherein said seat assembly is configured to be mounted on a flat leveled floor.

17. The dual motion recline mechanism of claim 1, wherein said seat carrier chassis plate is operatively connected to said seat frame assembly by said pair of seat pivot pins, wherein said pair of seat pivot pins are pivotal connections allowing said seat frame assembly to pivot.

18. The dual motion recline mechanism of claim 1, further comprising a fixed base attached to said chassis mounting plate.

19. The dual motion recline mechanism of claim 1, further comprising a back frame guide block attached to said back frame assembly.

* * * * *